US008416050B2

(12) United States Patent
Mino

(10) Patent No.: US 8,416,050 B2
(45) Date of Patent: Apr. 9, 2013

(54) INDUCTOR

(75) Inventor: Kazuaki Mino, Hino (JP)

(73) Assignee: Fuji Electric Co., Ltd., Kawasaki-Shi (JP)

( * ) Notice: Subject to any disclaimer, the term of this patent is extended or adjusted under 35 U.S.C. 154(b) by 0 days.

(21) Appl. No.: 12/929,686

(22) Filed: Feb. 8, 2011

(65) Prior Publication Data

US 2011/0199175 A1 Aug. 18, 2011

(30) Foreign Application Priority Data

Feb. 12, 2010 (JP) ..... 2010-029204

(51) Int. Cl.
*H01F 27/28* (2006.01)
*H01F 21/02* (2006.01)
*H01F 27/29* (2006.01)
*H01F 27/24* (2006.01)

(52) U.S. Cl. ..... 336/229; 336/147; 336/170; 336/186; 336/192; 336/221; 336/184

(58) Field of Classification Search ..... 336/186, 336/192, 146, 147, 170, 220–222, 229, 184
See application file for complete search history.

(56) References Cited

U.S. PATENT DOCUMENTS

| | | | | |
|---|---|---|---|---|
| 1,785,819 | A * | 12/1930 | Silent | 323/305 |
| 3,363,165 | A * | 1/1968 | Wilkinson | 363/68 |
| 5,731,740 | A * | 3/1998 | van de Westerlo | 330/276 |
| 2007/0115087 | A1 * | 5/2007 | Lee et al. | 336/229 |

FOREIGN PATENT DOCUMENTS

JP 62-007101 A 1/1987

* cited by examiner

*Primary Examiner* — Mohamad Musleh
*Assistant Examiner* — Mangtin Lian
(74) *Attorney, Agent, or Firm* — Rabin & Berdo, P.C.

(57) ABSTRACT

Two conducting wires are used in one embodiment of an inductor. Opposite ends of each of the conducting wires are connected to leader lines (terminals) shared by the conducting wires. Each of the conducting wires is wound to make half a round of an annular or ring-like magnetic substance. One of the conducting wires is wound around a lower half area of the magnetic substance to form one winding while the other conducting wire is wound around an upper half area of the magnetic substance to form another winding. In this manner, the distance between the leader lines can be increased to eliminate parasitic capacitance between the leader lines. The magnetic fluxes generated by current flowing in the two windings are in the same direction. Thus, it is possible to provide an inductor whose total parasitic capacitance is reduced. In other embodiments, additional conducting wires are used.

6 Claims, 5 Drawing Sheets

TOP VIEW OF CONFIGURATION EXAMPLE (FIRST EMBODIMENT) OF INDUCTOR ACCORDING TO THE INVENTION

TOP VIEW OF CONFIGURATION EXAMPLE (FIRST EMBODIMENT) OF INDUCTOR ACCORDING TO THE INVENTION

SIDE VIEW OF THE SAME CONFIGURATION EXAMPLE

DIAGRAM SHOWING EQUIVALENT CIRCUIT
OF THE INDUCTOR SHOWN IN FIGS. 1A AND 1B

SHOWING ANOTHER CONFIGURATION EXAMPLE
(SECOND EMBODIMENT) OF
THE INDUCTOR ACCORDING THE INVENTION

TOP VIEW OF CONFIGURATION EXAMPLE OF BACKGROUND-AT INDUCTOR

SIDE VIEW OF THE SAME CONFIGURATION EXAMPLE

DIAGRAM SHOWING EQUIVALENT CIRCUIT OF THE BACKGRAOUND-ART INDUCTOR SHOWN IN FIGS. 4A AND 4B

CIRCUIT DIAGRAM OF POWER FACTOR CORRECTION CIRCUIT TO WHICH INDUCTOR IN FIGS. 4A AND 4B IS APPLIED

INDUCTOR

CROSS-REFERENCE TO RELATED APPLICATION

This application claims the benefit of foreign priority of Japanese application 2010-029204, filed Feb. 12, 2010, the disclosure of which is incorporated herein by reference.

BACKGROUND OF THE INVENTION

1. Field of the Invention

The present invention relates to an inductor.

2. Description of the Background Art

In the background art, there has been known an electronic component, that is, a so-called inductor, in which conducting wires are wound around a magnetic substance to obtain a desired inductance value or conducting wires are wound around an air core (such as a nonmagnetic bobbin, or nothing to serve as a core) to obtain a desired inductance value.

FIGS. 4A and 4B show a configuration example of a background-art inductor. FIG. 4A is a top view, and FIG. 4B is a side view.

A background-art inductor 50 has a configuration, for example, in which windings are formed by winding conducting wires around a magnetic substance 55. The magnetic substance 55 has a donut-like shape in the example shown in FIGS. 4A and 4B. The magnetic substance 55 may be regarded as an example of a so-called "toroidal core". In addition, in the configuration example shown in FIGS. 4A and 4B, windings are formed out of two conducting wires (illustrated as two conducting wires 53 and 54). This configuration will be described below.

First, when a high-frequency current flows in a conducting wire, the current generally flows only near the surface of the conducting wire due to skin effect so as to increase loss. Therefore, windings are formed by use of a plurality of parallel conducting wires to increase the surface area of the conducting wires. When, for example, the two conducting wires 53 and 54 are used as shown in FIGS. 4A and 4B, the conducting wires 53 and 54 are connected in parallel between leader lines 51 and 52 of the inductor and wound around the magnetic substance 55.

The leader lines 51 and 52 may be regarded as terminals shared between the two conducting wires 53 and 54 or may be regarded as terminals for connecting the inductor 50 to some circuit.

Any number of conducting wires may be used. The number of conducting wires is not limited to two as shown in the example, but may be three, four, five, . . . or the like. When the number of conducting wires is increased thus, the surface area is increased, the sectional area where a high-frequency current can flow is also increased, and the effect of suppressing the loss particularly in the case where a high-frequency current flows in the conducting wires is enhanced, in comparison with when the number of conducting wires is one.

Although an example in which the magnetic substance 55 is used as a core has been illustrated here, an air-core coil in which conducting wires are wound around a bobbin or the like for fixing the conducting wires without use of any magnetic substance may be used alternatively. Also in this case, a plurality of conducting wires may be used.

There has been known another background-art technique as disclosed in JP-A-62-7101.

The invention disclosed in JP-A-62-7101 relates to a common mode choke coil for coping with common mode noise. As shown in FIGS. 4 and 5 of JP-A-62-7101, a common mode choke coil is typically designed as follows. That is, a pair of windings 2 and 3 are provided so that magnetic fluxes generated in a magnetic core 1 in response to a round current (normal mode current) can be cancelled with each other. Thus, the common mode chock coil can serve as an inductor for common mode noise.

On the other hand, the aforementioned inductor shown in FIGS. 4A and 4B may be regarded as a configuration for coping with normal mode noise. In such a case, the inductor is called a normal mode choke coil.

In addition, the inductor shown in FIGS. 4A and 4B has a two-terminal configuration while the common mode choke coil in JP-A-62-7101 has a four-terminal configuration in which inductors are inserted into two wires of an AC line respectively.

The inductor (normal mode choke coil) shown in FIGS. 4A and 4B by way of example has a problem about parasitic capacitance as will be described below. A solution to the problem has been required.

Here, FIG. 5 shows an equivalent circuit of the background-art inductor 50 shown in FIGS. 4A and 4B.

The equivalent circuit has a configuration in which parasitic capacitances are connected in parallel to inductance L depending on the inductor 50, as illustrated in FIG. 5. Parasitic capacitances between wires of windings are generally known well. Parasitic capacitances a-1 to a-N illustrated in FIG. 5 correspond to these parasitic capacitances. As shown in FIG. 4A, the parasitic capacitances a-1 to a-N are electrostatic capacitances generated between adjacent wires in the windings. That is, each of the parasitic capacitances a-1 to a-N is a parasitic capacitance generated between adjacent conductors in each turn of conducting wires (53 and 54). Accordingly, N parasitic capacitances are generated in series in N turns of the windings. Therefore, the parasitic capacitances a-1 to a-N are connected in series in the equivalent circuit as illustrated in FIG. 5. The reference sign N designates the number of turns (winding number) of the windings. The parasitic capacitance is also called inter-wire capacitance, winding capacitance, or the like.

In the inductor configured as shown in FIGS. 4A and 4B, parasitic capacitance is also generated between the leader line 51 and the leader line 52. Parasitic capacitance b shown in FIG. 4A corresponds to the parasitic capacitance. As shown in FIG. 5, configuration is made so that the parasitic capacitance b is connected in parallel to the aforementioned configuration in which the parasitic capacitances a-1 to a-N are connected in series.

In the inductor configured as shown in FIGS. 4A and 4B, windings are formed to make a round of the donut-like magnetic substance. Thus, the distance between the leader line 51 and the leader line 52 is apt to be small enough to generate the parasitic capacitance b between the leader lines 51 and 52. As shown in the equivalent circuit of FIG. 5, the parasitic capacitance b is connected not in series with the parasitic capacitances a-1 to a-N but in parallel therewith, so as to give a great influence to total parasitic capacitance of the inductor. Thus, the total parasitic capacitance is increased conspicuously. This will be described below.

Here, description will be made on the assumption that the values of the parasitic capacitances a-1 to a-N and the parasitic capacitance b are all the same (=C) (that is, on the assumption that conducting wires are adjacent to each other with the same area and with the same distance). In this case, the total parasitic capacitance between the leader line 51 and the leader line 52 can be expressed by "C+C/N".

When the parasitic capacitance b is absent, the total parasitic capacitance is expressed by "C/N". Therefore, if the number N of turns is increased, the total parasitic capacitance will be a very small value. In fact, however, large parasitic capacitance is generated in the inductor due to the existence of the parasitic capacitance b as described above.

Even if the distance between adjacent conducting wires is not fixed but variable, the average distance will be fixed so that the total parasitic capacitance will remain unchanged. In addition, parasitic capacitance generated between wires not adjacent to each other takes a small value due to a long distance between the wires not adjacent to each other. Thus, such parasitic capacitance is negligible. Further, when adjacent conductors have the same potential, energy cannot be stored in parasitic capacitance generated between the adjacent conductors. Thus, such parasitic capacitance is negligible compared to the parasitic capacitance between the leader line 51 and the leader line 52.

When an inductor having such a large parasitic capacitance is used in a conversion circuit or the like, there arises the problem that the current for charging/discharging the parasitic capacitance increases and hence loss or high-frequency noise increases. The operation in the case where the inductor 50 having large parasitic capacitance is applied to a power factor correction circuit shown in FIG. 6 will be described by way of example.

The power factor correction circuit shown in FIG. 6 includes an AC power supply 61, a diode bridge 62, the inductor 50, a diode 66, a switching device 65 and a capacitor 67. The inductor 50 is an inductor configured as shown in FIGS. 4A and 4B. The inductor 50 is connected to the power factor correction circuit through leader lines 51 and 52 (terminals). As shown in FIG. 6, the leader line 51 is connected to the diode bridge 62 side, and the leader line 52 is connected to the diode 66 side. In the inductor 50, inductance L is obtained while parasitic capacitance 68 (the aforementioned total parasitic capacitance=C+C/N) arranged in parallel to the inductance L is generated.

When the switching device 65 is OFF and the diode 66 is ON in the power factor correction circuit shown in FIG. 6, a current flows in a path from the AC power supply 61 through the diode bridge 62, the inductor 50, the diode 66, the capacitor 67 and the diode bridge 62 back to the AC power supply 61. A difference between an AC power supply voltage and an output voltage is applied to the inductor 50.

Here, when the switching device 65 is turned ON, the path of the current changes to a path from the AC power supply 61 through the diode bridge 62, the inductor 50, the switching device 65 and the diode bridge 62 back to the AC power supply 61. Thus, the voltage of the inductor 50 changes to AC power supply voltage suddenly as soon as the switching device 65 is turned ON. On this occasion, the voltage of the parasitic capacitance 68 also changes suddenly. Therefore, when the switching device 65 is turned ON, a sharp spike-like current for charging the parasitic capacitance 68 flows in a path from the AC power supply 61 through the diode bridge 62, the parasitic capacitance 68, the switching device 65 and the diode bridge 62 back to the AC power supply 61. This current flows as soon as the switching device 65 is turned ON. Therefore, the current is repeated with a switching frequency to thereby increase the switching loss of the switching device 65.

In addition, when there is large parasitic capacitance in the inductor 50, high-frequency conducted noise generated due to switching in the switching device 65 or the diode 66 leaks to the power system side through the parasitic capacitance 68. To attenuate the noise, a noise filter (not shown here) must be enhanced. Thus, the apparatus is made larger in size and higher in cost. The power factor correction circuit has been described here by way of example. However, when an inductor with large parasitic capacitance is used even in any other circuit, the inductor causes similar problems (such as increase of loss, increase of conducted noise, etc.).

Such a problem is merely an example. Although such a problem is not limited to this example, existence of large parasitic capacitance in the inductor 50 is not desirable anyway. However, particularly in the case of a normal mode choke coil etc. in the configuration in which the distance between two leader lines (terminals) is short, the total parasitic capacitance increases.

In order to solve the aforementioned problem, for example, it can be considered that conducting wires 53 and 54 are wound not to make a round but to make half a round (180 degrees) or ¾ of a round (270 degrees) so as to increase the distance between the leader line 51 and the leader line 52, by way of example. In this case, however, there is formed a portion (dead space) in which no winding is formed on the magnetic substance 55. Thus, there arise a problem that a desired number of turns cannot be obtained, a problem that a winding cannot be thickened to a desired thickness, a problem that the conduction loss increases, etc.

The configuration of the inductor is not limited to the example shown in FIGS. 4A and 4B. The example shown in FIGS. 4A and 4B has a configuration in which conducting wires are wound around a magnetic substance. As another configuration of the inductor, a so-called "air-core coil" or the like may be used. As described above, the air-core coil has a configuration in which conducting wires are wound around a bobbin for fixing the conducting wires without use of any magnetic substance. It is not necessary to be limited to this configuration, but another configuration using no bobbin (no core around which conducting wires should be wound) may be used.

SUMMARY OF THE INVENTION

An object of the invention is to provide an inductor. Particularly, it is to provide an inductor or the like in which parasitic capacitance between opposite terminals of windings can be eliminated to reduce total parasitic capacitance on a large scale, so that loss or conducted noise can be reduced.

An inductor according to the invention includes: a ring-like core part; and a plurality of conducting wires which are wound around the ring-like core part; wherein: each of the conducting wires has one end connected to a first terminal and the other end connected to a second terminal; and the conducting wires are wound around desired areas of the ring-like core part to form a plurality of windings respectively so that magnetic fluxes generated by a current flowing through the respective windings can be trued up in the same direction, and the distance between the first terminal and the second terminal is set in such a manner that parasitic capacitance is prevented from being generated between the first terminal and the second terminal.

In the inductor, for example, configuration may be made so that the conducting wires are divided into two, that is, a first conducting wire and a second conducting wire; the ring-like core part is divided into two areas, that is, a first area and a second area; and the first conducting wire is wound around the first area to form a first winding, and the second conducting wire is wound around the second area to form a second winding.

In the inductor, for example, configuration may be made in such a manner that the first area and the second area partially overlap on each other so that there can be a portion in which the first winding and the second winding partially overlap on each other.

In the inductor, for example, configuration may be made so that the conducting wires include three or more conducting wires; the ring-like core part is divided into three or more areas; and each of the three or more conducting wires is wound around any one of the three or more areas to form three or more windings as the windings.

According to the invention, total parasitic capacitance can be reduced in the inductor. It is therefore possible to reduce the loss in a switching device when the inductor is applied to a conversion circuit or the like. Alternatively, it is possible to reduce conducted noise leaking to a power system or the like so that a noise filter can be made smaller in size, lower in cost and higher in efficiency.

DETAILED DESCRIPTION OF THE PREFERRED EMBODIMENTS

Embodiments of the invention will be described below with reference to the drawings.

Figure 1A:
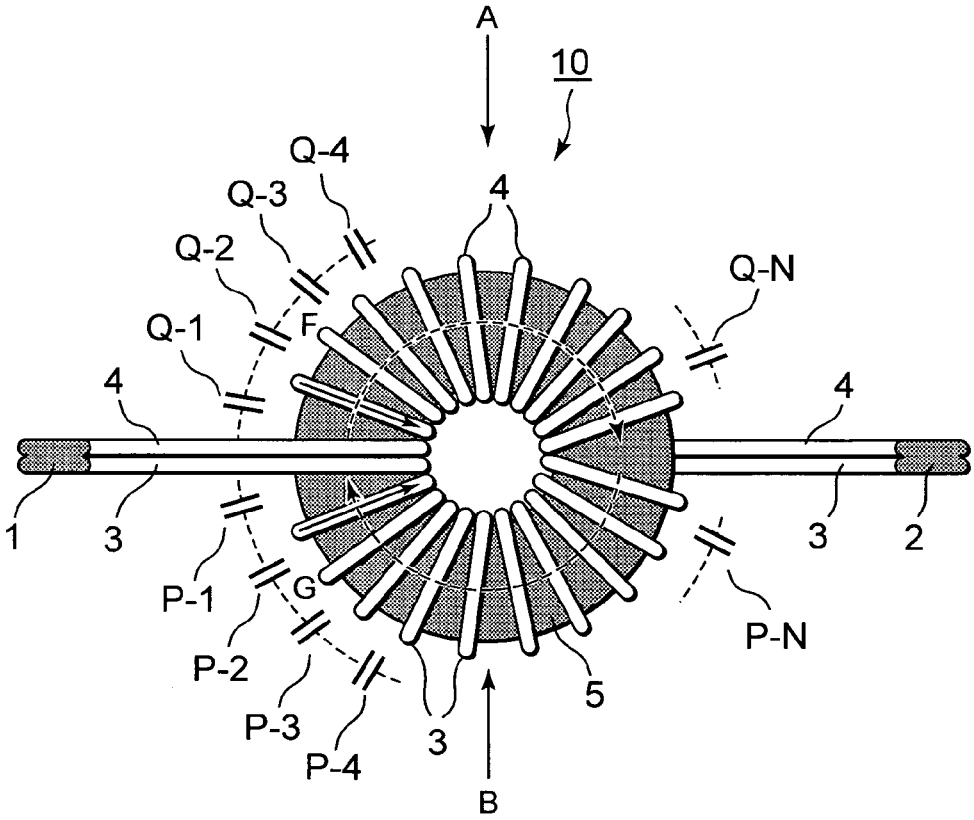
FIGS. 1A and 1B are a top view and a side view respectively, showing a configuration example (first embodiment) of an inductor according to the invention.
Figure 1B:
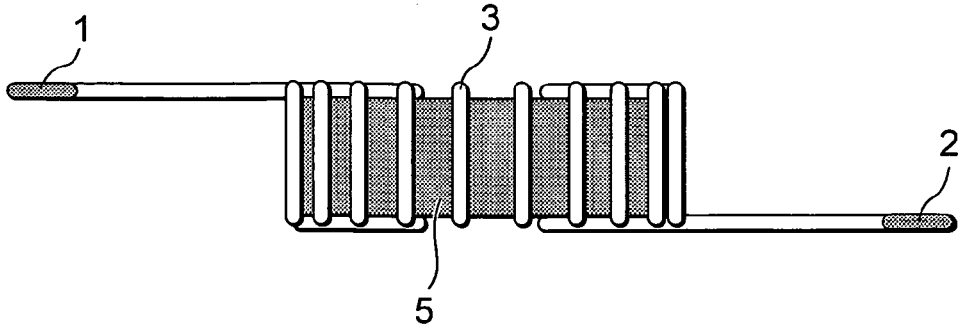

FIGS. 1A and 1B are diagrams showing a configuration example (first embodiment) of an inductor according to the invention. FIG. 1A is a top view and FIG. 1B is a side view.

Figure 2:
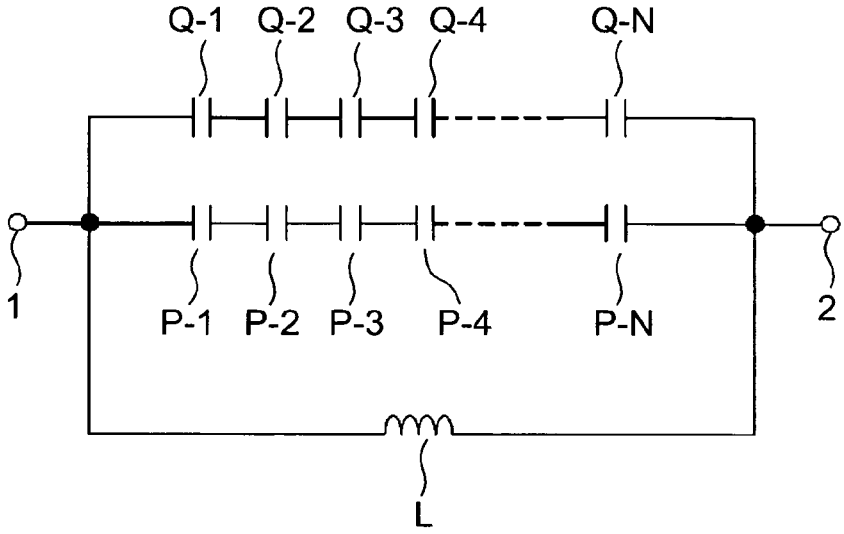
FIG. 2 is a diagram showing an equivalent circuit of the inductor shown in FIGS. 1A and 1B.

FIG. 2 is a diagram showing an equivalent circuit of the inductor shown in FIGS. 1A and 1B.

Figure 4A:
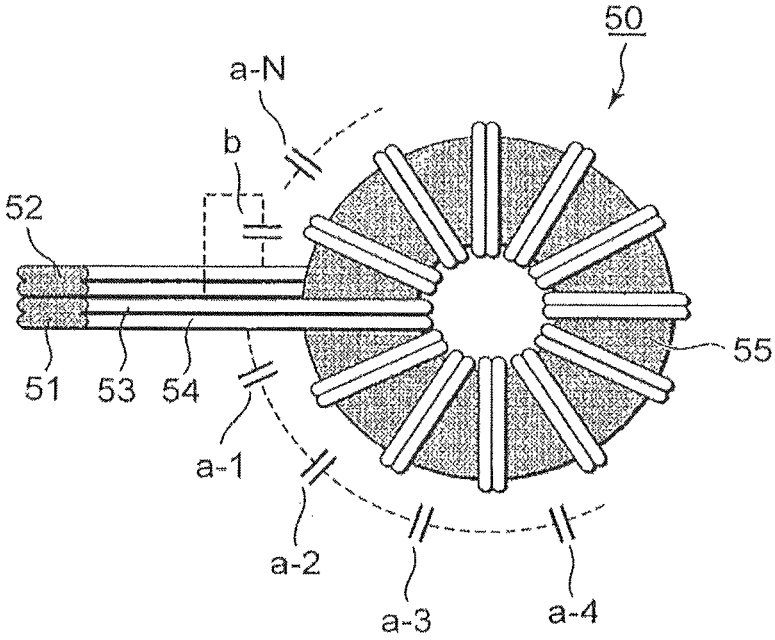
FIG. 4A PRIOR ART
FIGS. 4A and 4B are a top view and a side view respectively, showing a configuration example of a background-art inductor.
Figure 4B:
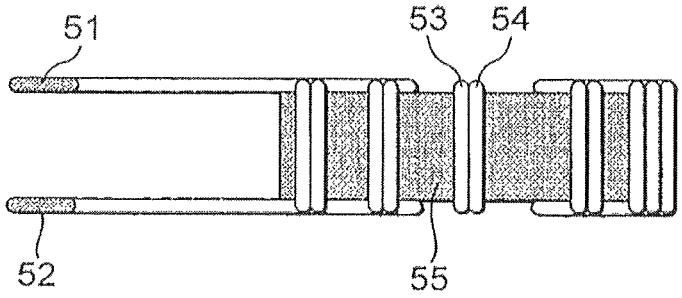
FIG. 4B PRIOR ART
Figure 5:
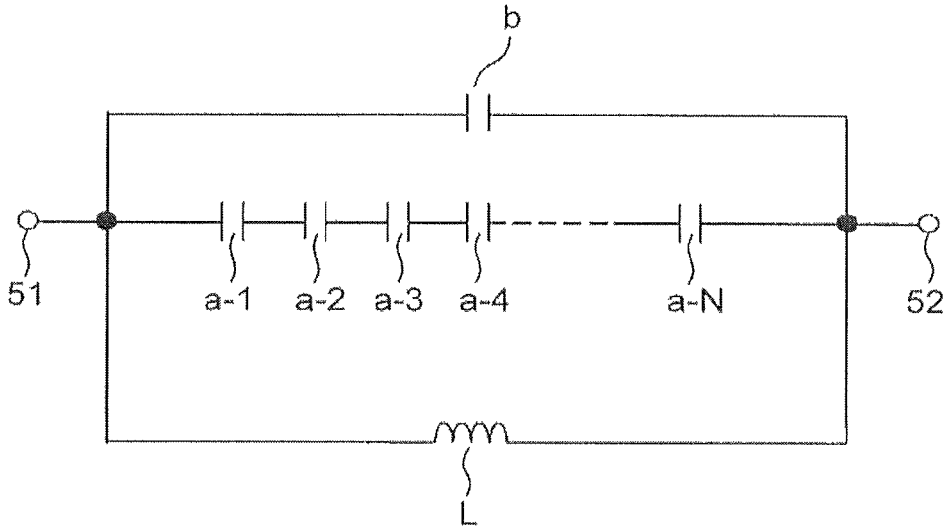
FIG. 5 PRIOR ART
FIG. 5 is a diagram showing an equivalent circuit of the background-art inductor shown in FIGS. 4A and 4B.

Also in this embodiment, a configuration in which a plurality of conducting wires are wound around a magnetic substance 5 is used fundamentally in the same manner as in the background-art inductor shown in FIGS. 4A and 4B. In an inductor 10 shown in FIGS. 1A and 1B, two conducting wires 3 and 4 are used to form windings. The opposite ends of each conducting wire 3, 4 are connected to shared terminals (leader lines 1 and 2), and the conducting wires 3 and 4 are connected in parallel between the leader line (terminal) 1 and the leader line (terminal) 2.

The reason why a plurality of conducting wires (two conducting wires 3 and 4 in this embodiment) are used is to increase the surface area and increase the sectional area where a high-frequency current can flow to thereby suppress occurrence of loss, as described previously.

The conducting wires 3 and 4 in this embodiment are disposed in parallel with each other near the leader lines 1 and 2 in the same manner as the conducting wires 53 and 54. However, the conducting wires 3 and 4 in this embodiment are separated and wound around the magnetic substance 5 separately as illustrated in FIGS. 1A and 1B whereas the conducting wires 53 and 54 kept in parallel with each other are wound around the magnetic substance 55.

One or both of the conducting wires 3 and 4 may be made of a plurality of conducting wires. For example, the conducting wire 3 may be made of two conducting wires while the conducting wire 4 may be made of a single conducting wire. In this case, the inductor 10 is substantially made of three conducting wires. Incidentally, in this case of the example, the two conducting wires forming the conducting wire 3 are wound around the magnetic substance 5 while they are kept in parallel with each other.

The leader lines 1 and 2 may be regarded as terminals for connecting the inductor 10 to some kind of circuit. That is, the inductor 10 is a two-terminal inductor with two leader lines (terminals) as described above, differently from a four-terminal inductor, for example, disclosed in JP-A-62-7101.

The configuration of this embodiment is different from the background-art configuration shown in FIGS. 4A and 4B, in terms of the way to wind the conducting wires 3 and 4 and hence the positional relationship between the leader lines 1 and 2.

That is, first, in the background art, the conducting wires 53 and 54 kept in a pair and in parallel with each other are wound around the magnetic substance 55 together to make almost a round of the magnetic substance 55. Since the conducting wires 53 and 54 make almost a round to return to the vicinities of their original positions, one end (leader line 51) of the conducting wires 53 and 54 approaches the other end (leader line 52) of the conducting wires 53 and 54. Thus, as described above, parasitic capacitance is also generated between the terminals (leader lines 51 and 52) shared by a plurality of conducting wires. This parasitic capacitance increases total parasitic capacitance. In the case of the background-art configuration shown in FIGS. 4A and 4B, the positional relationship between the leader line 51 and the leader line 52 can be regarded as relationship of about 360 degrees. On the other hand, in the inductor shown in FIGS. 1A and 1B, the conducting wires 3 and 4 are arranged in parallel with each other in the vicinities of the leader lines 1 and 2 but separated from each other and wound around the magnetic substance 5 in different sites. That is, as illustrated in FIG. 1A, the conducting wire 3 is wound around a lower half area of the magnetic substance 5 to form one winding while the conducting wire 4 is wound around an upper half area of the magnetic substance 5 to form another winding. That is, the conducting wires 3 and 4 are wound around the magnetic substance 5 in different sites (areas) from each other in the magnetic substance 5 so that each of the conducting wires 3 and 4 makes half a round of the magnetic substance 5. In this manner, two windings are formed.

Since the conducting wires 3 and 4 are wound not to make a round together as in the background art but to make half a round separately, the positional relationship of about 180 degrees is established between the leader line 1 and the leader line 2. That is, the leader line 1 and the leader line 2 are located on the opposite sides with respect to the magnetic substance 5 as illustrated in FIGS. 1A and 1B. Thus, the distance between the leader line 1 and the leader line 2 can be increased to prevent parasitic capacitance from being generated between the leader line 1 and the leader line 2 (even if parasitic capacitance is generated, the value of the parasitic capacitance will be so small to be negligible). As a result, the total parasitic capacitance of the inductor 10 takes a very small value as compared with that in the background art.

In addition, in the configuration shown in FIGS. 1A and 1B, a portion (dead space) where no winding is formed can be prevented from appearing in the magnetic substance 5, and the aforementioned problem caused by the dead space can be prevented from arising. The same thing can be applied to modifications which will be described later or a configuration of FIG. 3. The configuration according to the invention is characterized in that a dead space can be prevented from being formed.

Further, the two windings of the conducting wires 3 and 4 are formed so that the direction of magnetic flux generated by the winding of the conducting wire 3 coincides with the direction of the magnetic flux generated by the winding of the conducting wire 4 when a current flows into the windings of the conducting wires 3 and 4 from the leader line 1 to the leader line 2. In other words, the windings of the conducting wires 3 and 4 are formed in such a manner that when the direction of magnetic flux generated by the winding of the conducting wire 3 is a "clockwise" direction as indicated by the broken-line arrow in FIG. 1A, the direction of the magnetic flux generated by the conducting wire 4 is also a "clockwise" direction as indicated by the broken-line arrow in FIG. 1A when a current flows from the leader line 1 to the leader line 2.

As a result, when a current flows from the leader line 1 to the leader line 2, the current flows through the windings of the respective conducting wires 3 and 4 in the arrow direction indicated in FIG. 1A (from the outer circumferential side of the donut shape to the inner circumferential side thereof). Thus, magnetic fluxes generated by the conducting wires 3 and 4 have the "clockwise" direction as illustrated by the broken-line arrows in FIG. 1A.

Here, in the background-art technique disclosed in JP-A-62-7101, a plurality of conducting wires are wound around a magnetic core in different sites respectively. However, this technique relates not to a normal mode inductor but a common mode inductor. Therefore, according to the background-art technique, the directions of magnetic fluxes generated by a current (normal mode current) flowing into respective windings operate to be reverse to each other so as to cancel each other in a normal mode so that a large inductance value cannot be obtained.

On the other hand, in the configuration according to the invention, magnetic fluxes have the same direction to prevent themselves from cancelling each other as described above.

Further, the background-art technique disclosed in JP-A-62-7101 provides a four-terminal configuration in which inductors are inserted into two wires of an AC line respectively. The configuration differs from the configuration of the embodiment in which parasitic capacitance can be further reduced by a two-terminal inductor.

In addition, as described previously, when a high-frequency current flows into a conducting wire, the current flows only near the surface of the conducting wire due to skin effect so as to increase loss. In the configuration according to the invention, a plurality of conducting wires are used in parallel to form windings, so that it is also possible to obtain an effect to suppress increase of loss particularly when a high-frequency current flows into the conducting wires.

In addition, as described previously, the background-art inductor shown in FIGS. 4A and 4B may be called a normal mode choke coil by contrast to the common mode choke coil in JP-A-62-7101. The inductor according to this embodiment shown in FIGS. 1A and 1B or FIG. 3 may be regarded as normal mode choke coil. Since the inductor according to this embodiment has two terminals as described above, the inductor may be regarded as "two-terminal normal mode choke coil".

In addition, a common mode choke coil is often recognized to typically have a coil structure of "two windings (in the case of a single phase) or three windings (in the case of three phases) on one core", and a normal mode choke coil is often recognized to typically have a coil structure of "one winding on one core". The coil structure of the inductor according to this embodiment, which is shown in FIGS. 1A and 1B etc., can be regarded as "a normal mode choke coil which however has "a plurality (two in FIGS. 1A and 1B and four in FIG. 3, etc.) of windings on one core"".

It is desired to wind the conducting wires 3 and 4 to make the number of turns of the conducting wire 3 coincide with the number of turns of the conducting wire 4. Here, description will be made on the assumption that the number of turns is N in each of the conducting wires 3 and 4.

In addition, the magnetic substance 5 is an example of a core forming the inductor according to this embodiment. Here, the magnetic substance 5 may be regarded as identical to the magnetic substance 55. Although an example of a so-called "toroidal core" is used as the donut-like magnetic substance. However, any core having a shape of which windings can be wound to make a round will not lose the effect of the invention.

Here, FIG. 2 shows an equivalent circuit between the leader lines 1 and 2 in the inductor 10 shown in FIGS. 1A and 1B.

As shown in FIG. 2, the equivalent circuit of the inductor 10 has a configuration in which a parasitic capacitance group involving the conducting wire 3 and a parasitic capacitance group involving the conducting wire 4 are connected in parallel to inductance L.

The parasitic capacitance group involving the conducting wire 3 includes parasitic capacitances P-1 to P-N generated between adjacent conductors in each turn of the conducting wire 3 as shown in FIG. 1A. As shown in FIG. 2, the parasitic capacitances P-1 to P-N are connected in series.

In the same manner, the parasitic capacitance group involving the conducting wire 4 includes parasitic capacitances Q-1 to Q-N generated between adjacent conductors in each turn of the conducting wire 4 as shown in FIG. 1A. As shown in FIG. 2, the parasitic capacitances Q-1 to Q-N are connected in series.

In this configuration, no parasitic capacitance is generated between the leader line 1 and the leader line 2 (or generated capacitance is small enough to be regarded as zero).

Thus, the total parasitic capacitance of the inductor 10 in this embodiment is smaller than that in the background-art technique, as will be described below.

First, assume that the number N of turns of each of conducting wires 3, 4 is equal to the number N of turns in the background-art inductor 50 shown in FIGS. 4A and 4B. Each of conducting wires 3, 4 reaches the number N of turns in half a round in this embodiment while each conducting wire reaches the number N of turns in a full round in the background art. Accordingly, in the inductor 10 shown in FIGS. 1A and 1B, the same number N of turns as that in the background art is arranged in a space which is half as large as that in the background art. Thus, the distance between adjacent conductors is about "½" (about half) as long as that in the background art. Each parasitic capacitance is therefore twice.

In the description of the background art, the value of each parasitic capacitance is expressed by "C". Therefore, each value of the parasitic capacitances P-1 to P-N and the parasitic capacitances Q1 to Q-N can be expressed by "2C". Thus, the total parasitic capacitance involving the conducting wire 3 can be expressed by "2C/N" because the parasitic capacitances P-1 to P-N each having a value of "2C" are connected in series. In the same manner, the total parasitic capacitance involving the conducting wire 4 can be expressed by "2C/N" because the parasitic capacitances Q-1 to Q-N each having a value of "2C" are connected in series.

Therefore, the total parasitic capacitance between the leader lines 1 and 2 can be expressed by "4C/N" (=2C/N+2C/N). On the other hand, as described previously in the description of the background art, the total parasitic capacitance between the leader lines 51 and 52 is expressed by "C+C/N". Thus, in the configuration according to the invention, the total parasitic capacitance can be made smaller than that in the background art. This effect is enhanced with increase of the value N.

When, for example, N=40, the parasitic capacitance is 41C/40 (≅C) in the background-art technique whereas the parasitic capacitance is C/10 in the invention. Thus, the parasitic capacitance can be reduced to about 1/10. Further, when N=80, the parasitic capacitance is 81C/80 (≅C) in the background-art technique whereas the parasitic capacitance is C/20 in the invention. Thus, the parasitic capacitance can be reduced to about 1/20.

Figure 6:
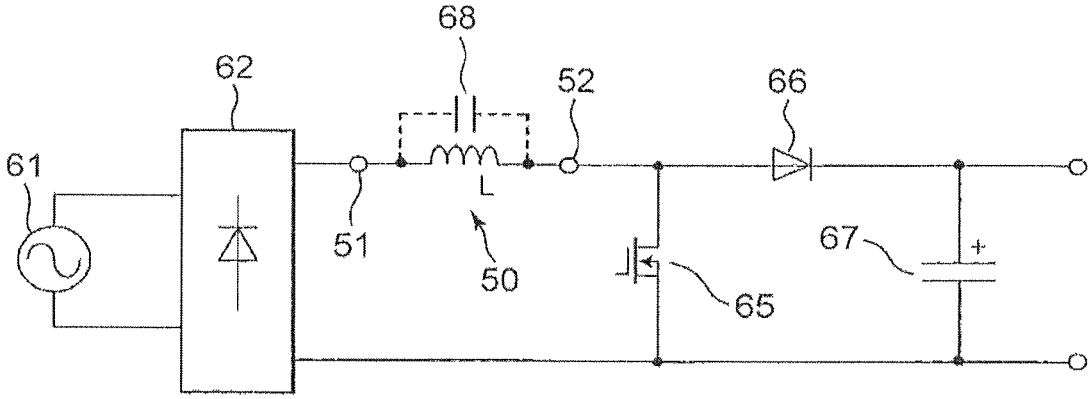
FIG. 6 PRIOR ART
FIG. 6 is a circuit diagram of a power factor correction circuit to which the inductor in FIGS. 4A and 4B is applied.

The inductor 10 whose total parasitic capacitance is much smaller than that in the background art is obtained thus, so that loss in a switching device or the like can be reduced when the inductor 10 is applied to a conversion circuit or the like. When, for example, the inductor 10 according to this embodiment is used in place of the inductor 50 in the aforementioned power factor correction circuit of FIG. 6, it is possible to reduce a sharp current flowing when the switching device 65 is turned on so that it is possible to reduce switching loss. Further, conducted noise flowing in a power system through the parasitic capacitance is also reduced so that a noise filter can be made smaller in size and lower in cost.

The configuration shown in FIGS. 1A and 1B is an example. The invention is not limited to the example, but fundamentally configured in such a manner that a plurality of conducting wires (two conducting wires 3 and 4 here) serving to reduce the skin effect are separated and wound on different sites in the magnetic substance 5 respectively. That is, the magnetic substance 5 is divided into a plurality of areas, and any one of the conducting wires is wound around each area. When the conducting wires include the two conducting wires 3 and 4, the magnetic substance 5 is divided into two areas, and the two conducting wires 3 and 4 are wound around the two areas respectively. For example, the two areas are the lower half area and the upper half area of the magnetic substance 5.

Here, as described in the description of the background art and the problems, each of the parasitic capacitances a-1 to a-N generated between wires of windings is capacitance generated between adjacent wires of the windings, while the value of parasitic capacitance generated between wires not adjacent to each other is small enough to be negligible due to a long distance between the wires not adjacent to each other. As long as the value of parasitic capacitance generated between the leader lines 1 and 2 is small for the same reason and the total parasitic capacitance of the inductor is prevented from increasing, the positional relationship between the leader line 1 and the leader line 2 may be set desirably. That is, the invention is not limited to the configuration example in which a very long distance is set between the leader lines 1 and 2, such as the "configuration of 180 degrees" of FIGS. 1A and 1B.

Figure 3:
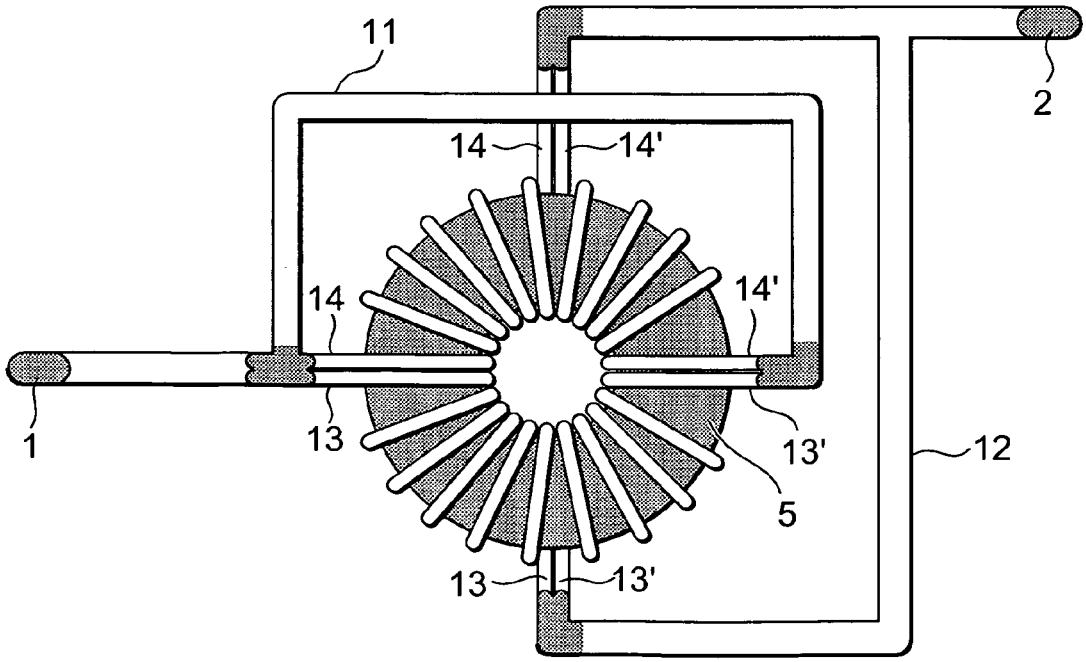
FIG. 3 is a diagram showing another configuration example (second embodiment) of the inductor according to the invention.

In addition, the number of conducting wires used as windings is not limited to two but three or more conducting wires may be used. This will be described later with reference to FIG. 3 showing a configuration example (second embodiment). Here, modifications in the case where two conducting wires are used will be described below.

A first modification will be described below.

First, as described previously, when two conducting wires are used, a fundamental configuration is made in such a manner that the magnetic substance 5 is divided into two areas and the two conducting wires are wound around the two areas respectively. FIGS. 1A and 1B show an example where the two areas consist of the upper half area and the lower half area of the magnetic substance 5. As described above, in this example, a positional relationship of about 180 degrees as shown in FIGS. 1A and 1B is established between the leader line 1 and the leader line 2.

However, the configuration is not limited to the example where the magnetic substance 5 is divided into halves in this manner. For example, the two areas may be a ¾ area and a ¼ area of the magnetic substance 5 respectively. That is, a positional relationship of about 90 degrees (or about 270 degrees) may be established between the leader line 1 and the leader line 2.

Here, assume that in the positional relationship of about 90 degrees, the leader line 2 is located in a position "A" shown in FIG. 1A. In this definition, therefore, the leader line 2 is located in a position "B" shown in FIG. 1A in the positional relationship of about 270 degrees. This explanation is made on the assumption that the position of the leader line 1 is unchanged just as shown in FIG. 1A.

In the example of FIGS. 1A and 1B, the conducting wire 3 is wound around a ½ area (the lower half) of the magnetic substance 5 while the conducting wire 4 is wound around a ½ area (the upper half) of the magnetic substance 5. For example, in the positional relationship of about 90 degrees, the conducting wire 3 is wound around a ¾ area (the lower half and the right half of the upper half) of the magnetic substance 5 while the conducting wire 4 is wound around a ¼ area (the left half of the upper half) of the magnetic substance 5. Also in this case, it is desirable to make the number of turns of the conducting wire 3 equal to that of the conducting wire 4, but they do not always have to be made equal to each other.

In the case of the configuration of 180 degrees, it is desirable to make the conducting wire 3 as thick as the conducting wire 4. On the other hand, in the case of about 90 degrees or 270 degrees, it is desirable to make the conducting wires 3 and 4 have different thicknesses. That is, it is desirable that the conducting wire which is wound around a wide area is made thick while the conducting wire which is wound around a narrow area is made thin. For example, in the case of about 90 degrees, the conducting wire 3 is made thick while the conducting wire 4 is made thin (in this case, when the thicknesses of the conducting wires 3 and 4 are made equal to each other and the numbers of turns of the conducting wires 3 and 4 are made equal to each other, the winding of the conducting wire 3 becomes sparse while the winding of the conducting wire 4 becomes dense).

Here, description will be made on how long the distance should be at least secured between the leader line 1 and the leader line 2. First, in FIGS. 4A and 4B in the background art, parasitic capacitance generated between wires not adjacent to each other is small enough to be negligible due to a long distance between the wires not adjacent to each other. Therefore, a condition can be conceived as follows. That is, when the distance between adjacent wires in FIGS. 4A and 4B is $\alpha$, the distance between the leader lines 1 and 2 is made longer than $\alpha$. Further, as described above, parasitic capacitance generated between wires not adjacent to each other is heretofore regarded as negligible (very small). This means that parasitic capacitance generated between wires which are at a distance not shorter than 2α can be regarded as negligible. From this fact, it can be therefore considered that the distance between the leader lines 1 and 2 is made not shorter than 2α. It is obvious that the aforementioned examples of 180 degrees, 90 degrees and 270 degrees satisfy the condition (not shorter than 2α).

According to another approach, the parasitic capacitance between the leader lines 1 and 2 should be made at least a certain degree smaller than that in the background art. For example, it can be considered that parasitic capacitance of about "C" in the background art should be reduced to "C/2" or lower. At any rate, it is an absolute requirement to make the total parasitic capacitance of an inductor smaller than that in the background art. It is therefore essential to make a configuration satisfying this requirement. No specific mention will be provided here in particular about the degree up to which the total parasitic capacitance should be reduced.

Figure 7:
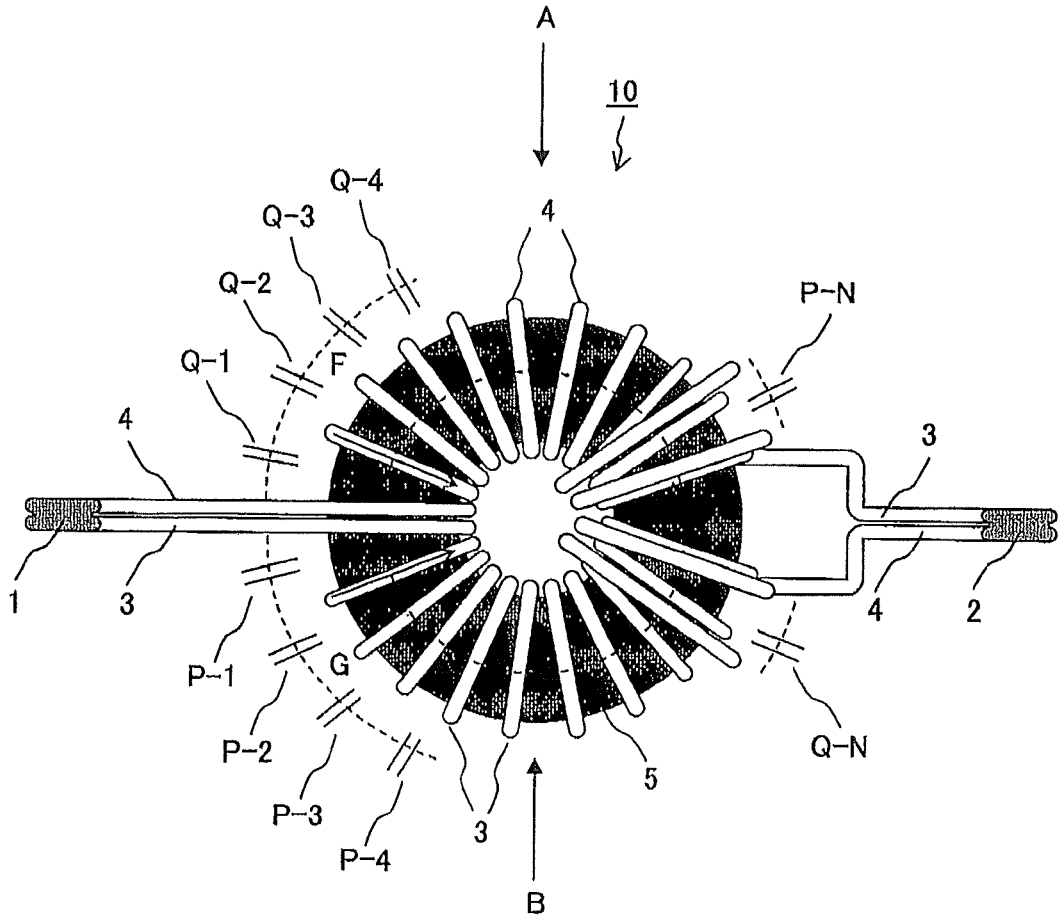
FIG. 7 is a top view of a modification of the inductor shown in FIGS. 1A and 1B.

In addition, in the configuration shown in FIGS. 1A and 1B or the first modification, the area on which the conducting wire 3 should be wound and the area on which the conducting wire 4 should be wound are perfectly separated in the magnetic substance 5. However, the invention is not limited to those examples. The sites where the two conducting wires 3 and 4 are wound may overlap on each other to some extent, as shown in FIG. 7. An effect, for example, similar to that in the configuration of FIGS. 1A and 1B etc. can be obtained without any problem even if the sites where the two conducting wires 3 and 4 are wound overlap on each other to some extent in order to secure a winding space due to adjustment of the winding diameter or the number of turns.

For example, in FIGS. 1A and 1B, the conducting wire 3 is wound around the lower half of the magnetic substance 5 while the conducting wire 4 is wound around the upper half of the magnetic substance 5. Alternatively, for example, configuration may be made so that the conducting wire 3 is wound around "the lower half and a part of the upper half" of the magnetic substance 5 while the conducting wire 4 is wound around "the upper half and a part of the lower half" of the magnetic substance 5. That is, the two areas may not be provided as perfectly separate areas but may be provided to overlap on each other partially. Therefore, windings in those areas are not always wound around perfectly separate sites, but may have portions overlapping on each other partially. For example, configuration may be made in such a manner that the conducting wire 3 starts at a position F in FIG. 1A to be wound around the "lower half" area while the conducting wire 4 starts at a position G in FIG. 1A to be wound around the "upper half" area. In this case, there is a portion between the positions F and G in FIG. 1A, where the two windings of the conducting wires 3 and 4 overlap on each other.

A second modification has such a configuration where windings may overlap on each other.

The configuration example of FIGS. 1A and 1B, the first modification, etc. may be regarded as configuration examples where the area where conducting wires should be wound in the magnetic substance (the area where windings should be formed) is divided into two. That is, these configuration examples can be considered that the area is "divided into two, i.e. the upper and lower halves" in FIGS. 1A and 1B and the area is "divided into two, i.e. a ¼ part and a ¾ part" by way of example in the first modification. The invention is not limited to such a configuration of two divisions, but may have, for example, a configuration of four divisions or the like. FIG. 3 shows an example of such a configuration. In other words, these two-division and four-division configurations can be regarded as a configuration to form two windings and a configuration to form four windings.

FIG. 3 is a diagram showing another configuration example (second embodiment) of the inductor according to the invention. Only a top view is shown in FIG. 3. Therefore, a side view is absent from FIG. 3. FIG. 3 may be regarded as an example where four conducting wires are used as windings.

Four conducting wires, i.e. conducting wires 13, 13', 14 and 14' are used as illustrated in FIG. 3. In FIG. 3, the reference numeral is attached to the opposite ends of each of the four conducting wires. To take the conducting wire 13 as an example, the reference numeral "13" is attached to one end and the other end of the conducting wire 13. In this manner, the portion on which each conducting wire is wound in the magnetic substance 5 will be understood with reference to FIG. 3.

That is, according to this embodiment, four conducting wires are used. Accordingly, the magnetic substance 5 is divided into four areas. The four conducting wires are wound around the four areas respectively to form four windings in total. In the example illustrated in FIG. 3, the conducting wire 13 is wound around an area of "the left half of the lower half" of the magnetic substance 5 to form one winding. In the same manner, the conducting wire 13' is wound around an area of "the right half of the lower half" of the magnetic substance 5 to form one winding, the conducting wire 14 is wound around an area of "the left half of the upper half" of the magnetic substance 5 to form one winding, and the conducting wire 14' is wound around an area of "the right half of the upper half" of the magnetic substance 5 to form one winding.

One end of each of the four conducting wires is connected to a connection member 11 illustrated in FIG. 3 and connected to the leader line 1 through the connection member 11, while the other end thereof is connected to a connection member 12 illustrated in FIG. 3 and connected to the leader line 2 through the connection member 12.

The condition for the way to wind the four conducting wires is the same as that in the configuration of FIGS. 1A and 1B. That is, as described previously, the configuration is made so that all the directions of magnetic fluxes generated by a current flowing through the windings of the conducting wires coincide with each other (e.g. to be "clockwise") so as not to cancel each other. The configuration shown in FIG. 3 satisfies such a condition.

At first glance, the connection member 11 looks in touch with or close to the conducting wires 14 and 14' in FIG. 3. In fact, the connection member 11 is not in touch with or close to any conducting wires 14, 14' (but is designed to be separated therefrom with at least a certain margin).

Thus, the area on which conducting wires should be wound may be divided not into two but into three or more (four in the aforementioned example) so as to form three or more windings to thereby make all the directions of magnetic fluxes in the windings coincide with each other when a current flows into the windings. Not to say, also in this case, configuration can be made so that the leader lines (terminals) 1 and 2 are separated at an enough distance from each other so as to prevent parasitic capacitance from being generated between the leader lines (terminals) 1 and 2, as illustrated in FIG. 3. Thus, similar effect to that in the configuration of FIGS. 1A and 1B or the like can be obtained.

In addition, the configuration example shown in FIGS. 1A and 1B or FIG. 3 may be regarded as an example of a so-called "toroidal core", in which conducting wires are wound around a magnetic substance. However, the configuration of the inductor according to this embodiment is not limited to such an example. For example, an "air-core coil" or the like may be used alternatively. As described previously in the description of the background art and the problems, the air-core coil has a configuration in which conducting wires are wound around a bobbin (nonmagnetic substance or the like) for fixing the conducting wires without use of any magnetic substance.

In addition, the magnetic substance 5 shown in FIGS. 1A and 1B or FIG. 3 has a donut-like shape which is substantially circular. The invention is not limited to such an example. Though not shown specially, for example, the magnetic substance 5 may have a triangular shape, a quadrangular shape, a hexagonal shape, an octagonal shape, or the like (for example, a UU core or the like). Alternatively, the magnetic substance 5 may have a donut-like shape which lacks a part of the donut. Any shape can be used if conducting wires can be wound to make almost a round (about 360 degrees) of the shape. Here, the shape is referred to as "ring-like/ring-shaped". Accordingly, a "ring-like/ring-shaped core" is not limited to the aforementioned donut-like core (substantially circular) but may include a triangular core, a quadrangular core, a hexagonal core, an octagonal core, etc.

In addition, a subject on which conducting wires should be wound to form an inductor is referred to as "core part". The word "core" generally means a magnetic substance. Here, however, the "core part" includes not only a magnetic substance but also a nonmagnetic substance (such as a bobbin). In addition, the "core part" may include a magnetic substance covered with a bobbin or the like (in this case, conducting wires are wound around the bobbin or the like).

From the above description, the inductor according to this embodiment can be fundamentally regarded as an inductor having a configuration in which conducting wires are wound around a "ring-like/ring-shaped" "core part". The conducting wires are wound in the same manner as in FIGS. 1A and 1B or FIG. 3. That is, each conducting wire is inserted into the hole of the "ring-like/ring-shaped" "core part" as many times as the predetermined number of turns. In other words, each conducting wire is wound in such a manner that the number of times to insert the conducting wire into the ring hole coincides with the number of turns.

The inductor according to this embodiment is an inductor having the aforementioned configuration in which "conducting wires are wound around a 'ring-like/ring-shaped' 'core part'". In order to solve the background-art problem that the total parasitic capacitance of an inductor in the background art increases due to the influence of parasitic capacitance between (terminals of) opposite ends of conducting wires wound around a core part, the inductor according to this embodiment is designed to generate no parasitic capacitance between (terminals of) the opposite ends of the conducting wires ("no" includes a value small enough to be negligible).

Here, "to generate no parasitic capacitance" is not limited to the case where there is no parasitic capacitance but may be defined to also include the case where parasitic capacitance has a value small to be negligible.

This fundamentally means that the distance between (leader lines (terminals) of) the opposite ends of the conducting wires wound around the core part is separated at a certain distance or more. In the example shown in FIGS. 1A and 1B, the positional relationship of 180 degrees with respect to the core part is established. The invention is not limited to the example. For example, as described previously, the positional relationship of 90 degrees or 270 degrees may be established. The configuration of FIGS. 1A and 1B can be regarded as a configuration where the core part is divided into two areas and the conducting wires are wound around the areas respectively when the number of conducting wires is two. With respect to this point, the same thing can be applied to the configuration where the positional relationship of 90 degrees or 270 degrees is established.

In addition, the two terminals (the leader lines 1 and 2, which can be indicated also as first and second terminals) shared among the conducting wires wound around the core part may have the positional relationship of 180 degrees, 90 degrees, 270 degrees, etc. as described above, as long as the distance between the first and second terminals satisfies the condition that no parasitic capacitance is generated between the first and second terminals (including not only the case where no parasitic capacitance is generated but also the case where the parasitic capacitance is small enough to be negligible) as described above. The two terminals are fundamentally located near the boundaries between the two areas respectively.

In the configuration of FIG. 1A, the conducting wire 3 is wound around the lower half area of the core part (magnetic substance 5) while the conducting wire 4 is wound around the upper half area thereof. As illustrated in FIG. 1A, the leader lines 1 and 2 (first and second terminals) are located near the boundaries between the upper half and the lower half.

In addition, as described previously, windings are not always formed in areas perfectly separately from each other, but the windings may overlap on each other to some extent.

In addition, the number of conducting wires is not limited to two as shown in the example, but it may be three or more. When, for example, the number of conducting wires is four, every two of the four conducting wires may be divided as one group in the configuration of FIGS. 1A and 1B so that two of the conducting wires are wound around the upper half area of the magnetic substance 5 while the other two conducting wires are wound around the lower half area of the magnetic substance 5, or the core part may be divided into four areas as shown in the example of FIG. 3 so that the conducting wires can be wound around the four areas respectively.

Based on the aforementioned definitions, the inductor according to the invention will be described. The inductor according to the invention can be regarded as an "inductor including a ring-like core part and a plurality of conducting wires which are wound around the ring-like core part, wherein: each of the conducting wires has one end connected to a first terminal and the other end connected to a second terminal; and the conducting wires are wound around desired areas of the ring-like core part to form a plurality of windings respectively so that magnetic fluxes generated by a current flowing through the respective windings can be trued up in the same direction, and the distance between the first terminal and the second terminal is set in such manner that parasitic capacitance is prevented from being generated between the first terminal and the second terminal".

The aforementioned inductor according to the invention may be regarded as an inductor in which "the conducting wires are divided into two, i.e. a first conducting wire and a second conducting wire. When, for example, two conducting wires are used, one is regarded as the first conducting wire while the other is regarded as the second wire. Alternatively, when four conducting wires are used and every two of the four conducting wires are divided as one group, two conducting wires are regarded as the first conducting wire while the other two conducting wires are regarded as the second conducting wire. The ring-like core part is divided into two areas, that is, a first area and a second area. The first conducting wire is wound around the first area to form a first winding, and the second conducting wire is wound around the second area to form a second winding. The first terminal is located in one of the two boundaries between the two areas, and the second terminal is located in the other boundary".

The aforementioned inductor according to the invention may be configured as "the first area and the second area may partially overlap on each other so that the first winding and the second winding can partially overlap on each other".

In addition, the aforementioned inductor according to the invention may be configured as "the conducting wires include three or more conducting wires; the ring-like core part is divided into three or more areas; and the three or more conducting wires are wound around the three or more areas respectively to form three or more windings as the windings".

Further, as described previously, the background-art inductor shown in FIGS. 4A and 4B may be called a normal mode choke coil by contrast to the common mode choke coil in JP-A-62-7101. The inductor according to the invention as shown in FIGS. 1A and 1B or FIG. 3 may be also regarded as a normal mode choke coil.

What is claimed is:

1. An inductor, comprising:

an annular core; and a first and second conducting wires which are wound around the core, each of the conducting wires having one end connected to a first terminal and the other end connected to a second terminal, wherein the first and second conducting wires are wound around different regions of the core to form a plurality of windings so that magnetic fluxes generated by a current flowing through the windings extends in the same direction, and parasitic capacitance between the first terminal and the second terminal is negligible, and wherein the first and second conducting wires are electrically connected to one another only at the first and second terminals, and are the only conducting wires that are wound around the core.

2. The inductor according to claim 1, wherein:

the core has a first region and a second region; and the first conducting wire is wound around the first region to form a first winding, and the second conducting wire is wound around the second region to form a second winding.

3. The inductor according to claim 1, wherein the inductor is a two-terminal normal mode choke coil.

4. The inductor according to claim 2, wherein the inductor is a two-terminal normal mode choke coil.

5. An inductor, comprising:

an annular core having a top side and a bottom side, the core additionally having a first arcuate portion, a second arcuate portion adjoining the first arcuate portion, a third arcuate portion adjoining the second arcuate portion, and a fourth arcuate portion adjoining the first and third arcuate portions;

a first wire that is wound around the first arcuate portion of the core, the first wire having an end that is connected to a first terminal and having an initial loop following the first terminal, the initial loop of the first wire having an outer segment that first passes over the top side of the core and an inner segment that passes under the bottom side of the core, the first wire additionally having another end that is connected to a second terminal and having a final loop before the second terminal, the final loop of the first wire having an inner segment that first passes over the top side of the core and an outer segment that passes under the bottom side of the core;

a second wire that is wound around the second arcuate portion of the core, the second wire having an end that is connected to the second terminal and having an initial loop following the second terminal, the initial loop of the second wire having an outer segment that first passes under the bottom side of the core and an inner segment that passes over the top side of the core, the second wire additionally having another end that is connected to a third terminal and having a final loop before the third terminal, the final loop of the second wire having an inner segment that first passes under the bottom side of the core and an outer segment that passes over the top side of the core;

a third wire that is wound around the third arcuate portion of the core, the third wire having an end that is connected to the third terminal and having an initial loop following the third terminal, the initial loop of the third wire having an outer segment that first passes over the top side of the core and an inner segment that passes under the bottom side of the core, the third wire additionally having another end that is connected to a fourth terminal and having a final loop before the fourth terminal, the final loop of the third wire having an inner segment that first passes over the top side of the core and an outer segment that passes under the bottom side of the core; and a fourth wire that is wound around the fourth arcuate portion of the core, the fourth wire having an end that is connected to the fourth terminal and having an initial loop following the fourth terminal, the initial loop of the fourth wire having an outer segment that first passes under the bottom side of the core and an inner segment that passes over the top side of the core, the fourth wire additionally having another end that is connected to the first terminal and having a final loop before the first terminal, the final loop of the fourth wire having an inner segment that first passes under the bottom side of the core and an outer segment that passes over the top side of the core.

6. The inductor of claim 5, wherein the first and third terminals are electrically connected to one another and the second and fourth terminals are electrically connected to one another.

* * * * *